US008448415B2

(12) United States Patent
Grant

(10) Patent No.: US 8,448,415 B2
(45) Date of Patent: May 28, 2013

(54) HORSE HALTER

(76) Inventor: Byron Grant, Roosevelt, UT (US)

( * ) Notice: Subject to any disclaimer, the term of this patent is extended or adjusted under 35 U.S.C. 154(b) by 776 days.

(21) Appl. No.: 12/562,784

(22) Filed: Sep. 18, 2009

(65) Prior Publication Data

US 2010/0071321 A1 Mar. 25, 2010

Related U.S. Application Data

(60) Provisional application No. 61/098,272, filed on Sep. 19, 2008.

(51) Int. Cl.
*B68B 1/02* (2006.01)

(52) U.S. Cl.
USPC ..... 54/24; 54/6.2

(58) Field of Classification Search
USPC ..... 54/24, 85, 6.2
See application file for complete search history.

(56) References Cited

U.S. PATENT DOCUMENTS

| | | | | | |
|---|---|---|---|---|---|
| 43,781 | A | | 8/1864 | Le Baron | |
| 153,911 | A | | 8/1874 | Reed | |
| 417,638 | A | * | 12/1889 | Harmon | 54/24 |
| 483,594 | A | * | 10/1892 | Averill | 54/24 |
| 721,572 | A | * | 2/1903 | Kubin | 54/6.2 |
| 734,004 | A | * | 7/1903 | Stiegler | 54/6.2 |
| 1,351,620 | A | * | 8/1920 | Canter | 54/6.2 |
| 1,525,676 | A | * | 2/1925 | Warnes | 54/6.2 |
| 3,312,039 | A | | 4/1967 | Reed | |
| 3,605,384 | A | | 7/1969 | Pacini | |
| 4,135,348 | A | | 1/1979 | Matthews | |
| 4,376,366 | A | | 3/1983 | Miller | |
| 4,459,795 | A | * | 7/1984 | Le Tixerant | 54/6.2 |
| 4,565,055 | A | | 1/1986 | Simpson | |
| 4,589,248 | A | | 5/1986 | Ruddock et al. | |
| 7,340,874 | B2 | | 3/2008 | Bechtold | |

FOREIGN PATENT DOCUMENTS

| | | | |
|---|---|---|---|
| DE | 102007036290 | * | 2/2009 |
| FR | 2744997 A1 | * | 8/1997 |
| FR | 2878842 A1 | * | 6/2006 |

OTHER PUBLICATIONS

Valleyvet.com Rope Halter, http://www.valleyvet.com/ct_detail.html?pgguid=2e87bf3f-7b6a-11d5-a192-00b0d0204ae5.
Noavel.net Noavel Headstall, http://www.noavel.net/The%20Noavel.shtml.
Difani's Backcountry Manufacturing Company Mule Halter, http://www.difanisbackcountry.com/c-6-headstalls-and-halters.aspx.
Cowboyway.com, Headstall: What They Are, The Main Parts, http://www.cowboyway.com/What/Headstalls.htm.

* cited by examiner

*Primary Examiner* — Son T Nguyen
(74) *Attorney, Agent, or Firm* — Buchanan Nipper

(57) ABSTRACT

A halter having a continuous headstall strap that fits over the poll of the horse's head and includes a lead attachment ring at the bottom of the headstall strap.

13 Claims, 5 Drawing Sheets

HORSE HALTER

PRIORITY/CROSS-REFERENCE TO RELATED APPLICATIONS

This application claims the priority date of the provisional application entitled HORSE HALTER filed by Byron Grant on Sep. 19, 2008 with application Ser. No. 61/098,272, the disclosure of which is incorporated by reference.

FIELD OF THE INVENTION

The invention generally relates to an apparatus for haltering horses, and more particularly to halters made of webbing or leather straps.

BACKGROUND OF THE INVENTION

Halters for horses are common in the art and have been for well over a century. Various halter types have been made over those years to address the needs of training, leading and tying horses. Common features of the halters found in the prior art include a nose band that encircles the nose of the horse and some sort of a poll strap or crown strap that fits over the back of the horse's head behind the ears. The problem with common halter designs is the strength of the halter is compromised due to the numerous fittings included in the halter to allow it to be mounted on or fit on the horse and removed from the horse.

The art includes examples of halters that are designed to break away easily if the horse becomes entangled in a feature in the environment or potentially entangled with its own feet. An example of this is U.S. Pat. No. 3,605,384 to Pacini titled Breakaway Halter.

SUMMARY OF THE INVENTION

The present invention addresses this weakness in available halter designs by including a headstall strap permanently formed and fastened into a continuous loop that fits over the poll of the horse and includes a lead attachment ring at the bottom of the headstall strap. This strap and the connection made to form the continuous loop are made of materials of adequate strength to control the horse and prevent the halter from breaking when the horse pulls back or jerks against the halter. This saves the owner of the horse the expense of replacing broken halters and protects the horse from harm or injury that may result if the horse becomes untied and free to run unsupervised in an area of unknown hazards.

The purpose of the Abstract of the Disclosure is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
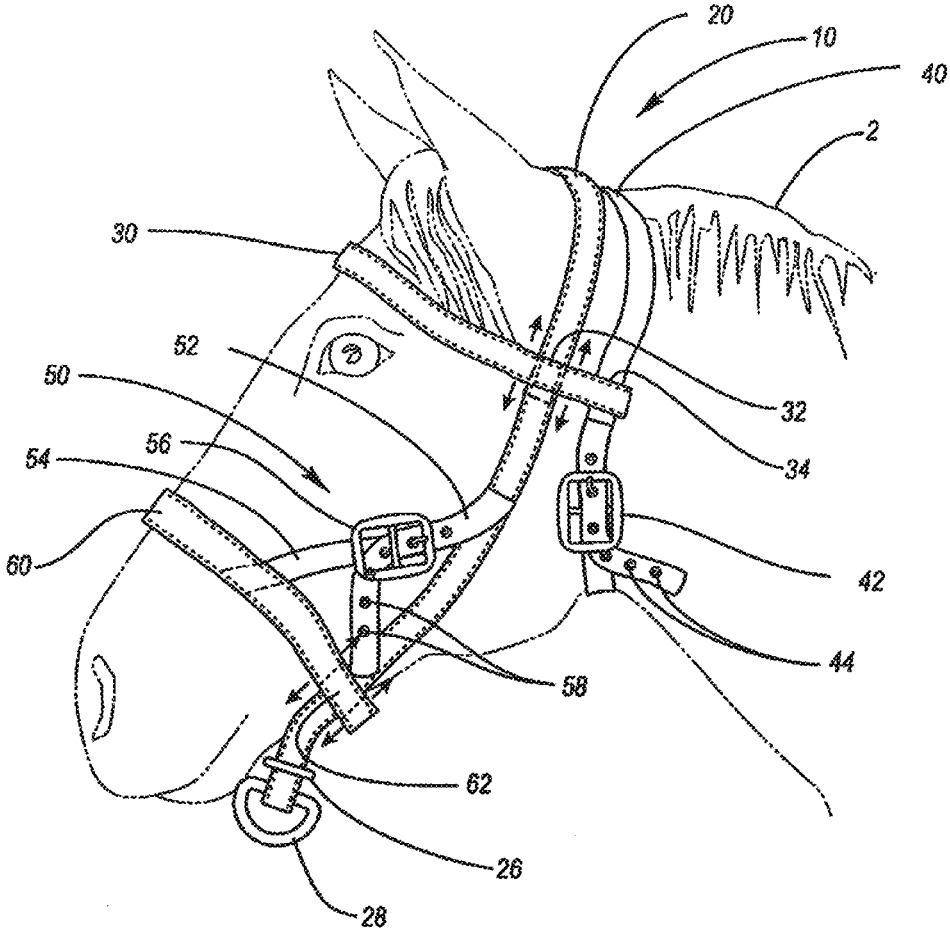
FIG. 1 shows one embodiment of a horse halter fitted on a horse.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Disclosed is a halter apparatus ("halter") 10 for a horse. FIG. 1 shows the halter 10 placed on a horse 2 and illustrates the general features of the halter including the continuous headstall strap 20, and a guide ring 26 that encompasses both sides of the headstall above the lead ring 28. The continuous headstall strap 20 passes through the lead ring 28. The continuous headstall strap is formed of leather, webbing or other suitable material and is formed into a continuous loop with a permanent, fixed high strength connection.

There is a brow band 30 which includes a headstall loop 32 fitted to slide on the headstall strap snug enough to retain its position unless it is moved by the owner and in a like manner a throat latch loop 34 that is also slidable on the throat latch strap 40. The brow band is preferably symmetrical and includes a headstall loop 32 and a throat latch loop 34 on each side of the halter. The throat latch 40 includes a buckle 42 and a number of adjustment holes 44 to allow adjustment for a proper fit when the halter is placed on a horse.

A nose band 60 is nonadjustable and sized to fit the horse. The nose band is attached to the headstall strap 20 on each side with headstall loops 62 that have a snug sliding fit on the headstall strap 20. The nose band position is adjusted by the hanger straps 50, one hanger strap is attached to each side of the halter each hanger strap includes an upper strap 52 that is fixed to the headstall strap 20 and has a number of holes 58 therethrough to allow adjustment.

A lower strap 54 that is fixed to the nose band 60, this attachment may be accomplished by sewing the lower strap to the nose band or alternatively it may be riveted or attachment may be made using a ring or a halter square of the three position type. The lower strap 54 has a buckle 56 attached at its top end to engage holes 58 in the upper strap 56 to allow nose band 60 position adjustment for a proper fit on the horse. This halter would typically be made of nylon webbing or strap in the alternative it may be made of leather or any other suitable material that will not chafe the horse. Material used to make the halter must possess adequate strength to control the horse without breaking or damaging the halter.

Figure 2:
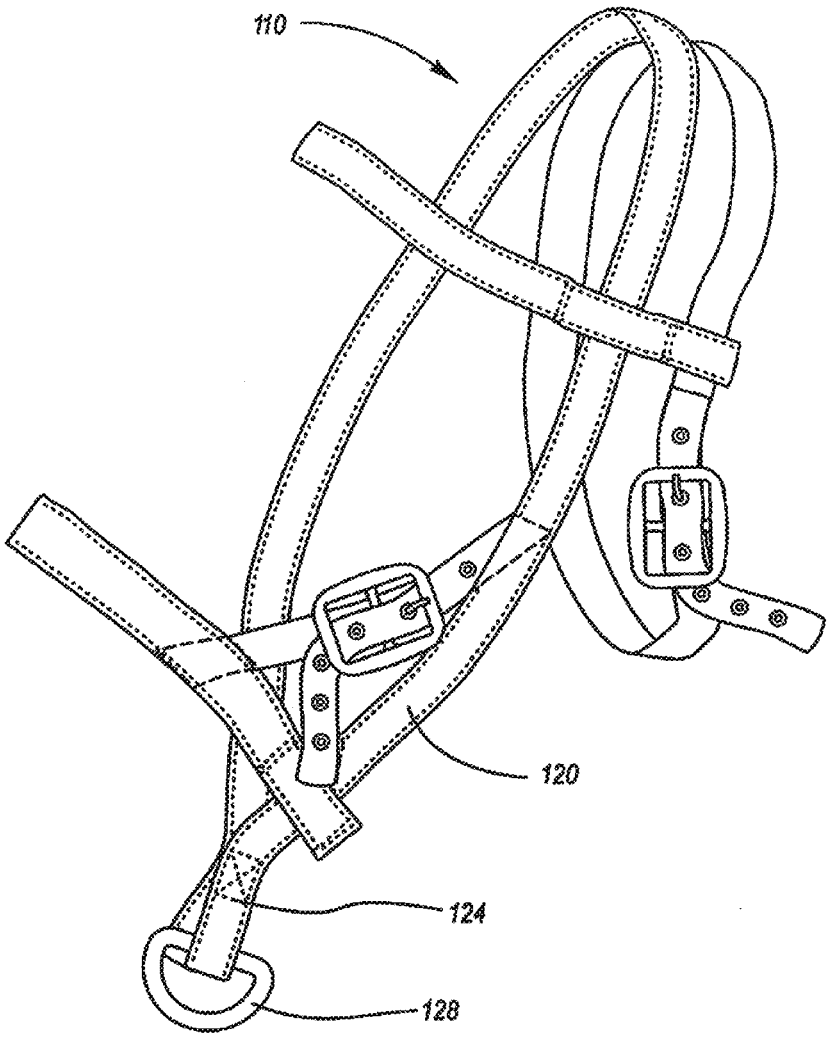
FIG. 2 shows a second embodiment of a horse halter not fitted on a horse.

The halter 110 of FIG. 2 differs from FIG. 1 in that the headstall strap 120 is stitched together at 124 above the lead ring 128 instead of having a guide ring installed. Otherwise the halter 110 of FIG. 2 is identical to the halter shown in FIG. 1 and simply represents an alternative method of construction.

Figure 3:
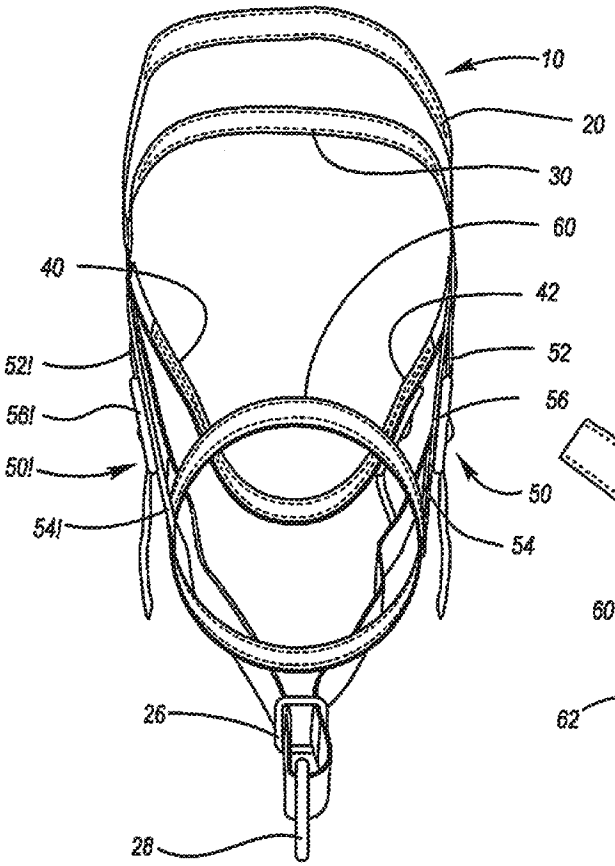
FIG. 3 shows a front view of the halter in FIG. 1 not fitted on a horse.

FIG. 3 shows the halter of FIG. 1 without the horse to more clearly illustrate the location of the parts of the halter. The location of the hanger straps on both sides of the halter are clearly shown at 50 and 50' and it is shown that the various parts of the upper and lower straps 52 and 54 on the left side are mirrored by 52' and 54' on the right side of the halter. Buckles 56 and 56' are shown on the left and right sides as they would fit to the left and right sides of the halter.

Figure 4:
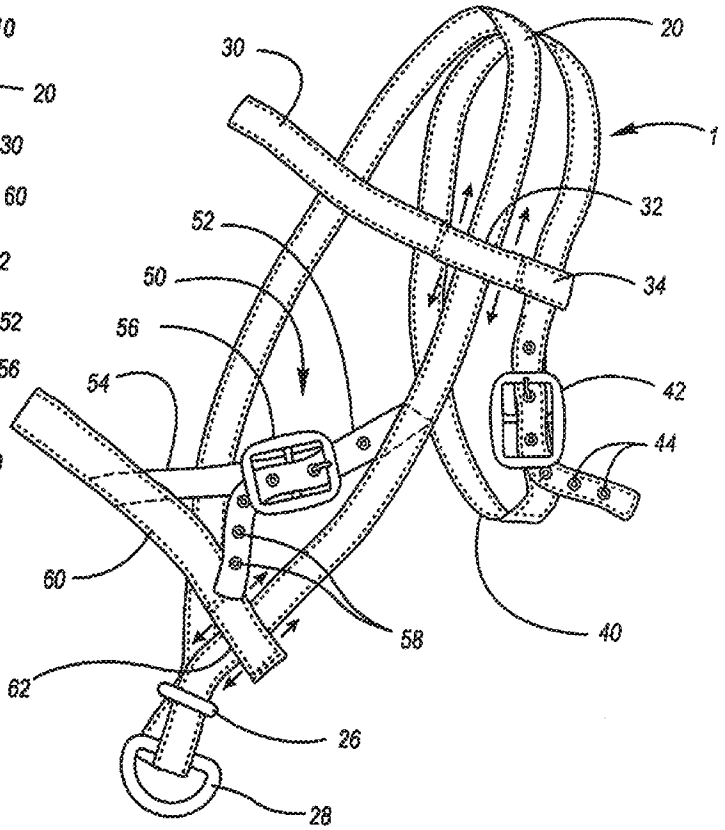
FIG. 4 shows a side view of the halter of FIG. 1 not fitted on a horse.

FIG. 4 shows a side view of the halter of FIG. 1, without the horse, and illustrates the continuous nature of the headstall strap 20 and also provides a clear illustration of the throat latch loop or strap 40.

Figure 5:
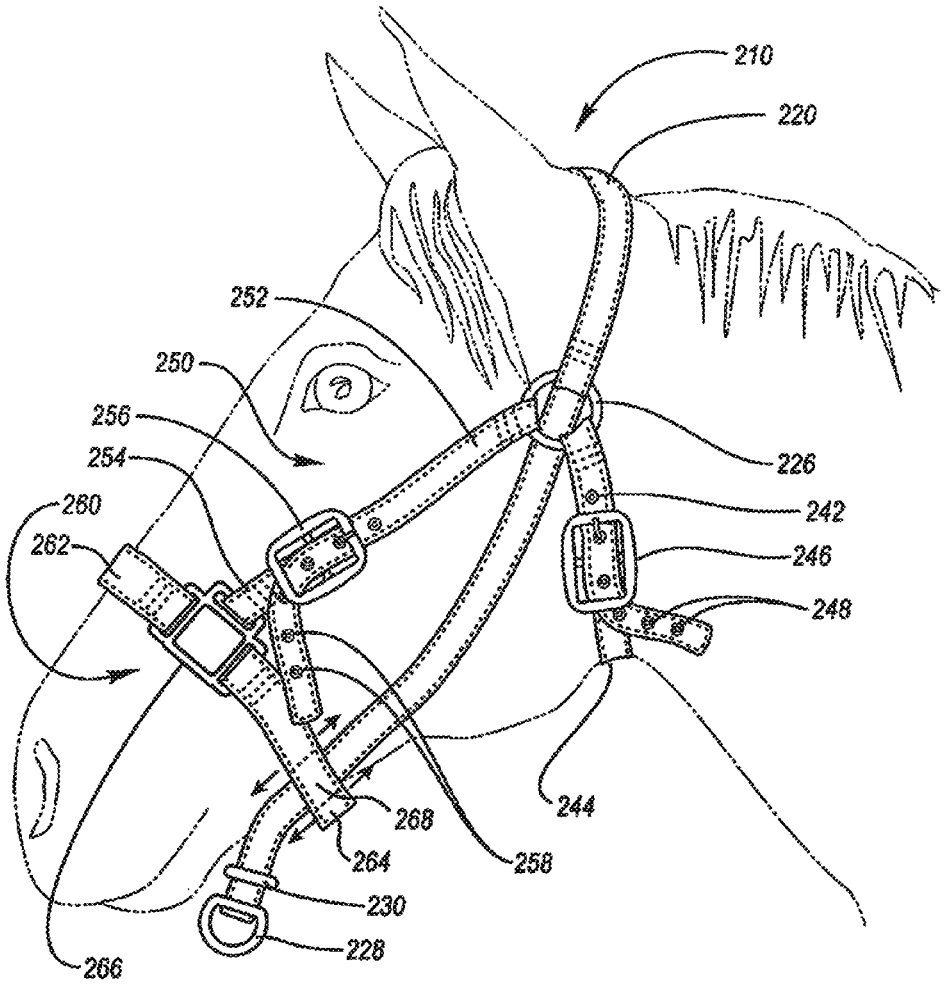
FIG. 5 shows a third embodiment of the horse halter fitted on a horse.

FIG. 5 shows the preferred embodiment of the halter 210 fitted on a horse. The halter 210 includes a continuous headstall strap 220, a lead ring 228, a guide ring 230 that encircles both sides of the headstall strap and will slide easily over the headstall strap 220 but will not pass over the lead ring 228. The continuous headstall strap is formed of leather, webbing or other suitable material and is formed into a continuous loop with a permanent, fixed, high strength connection.

Cheek rings 226 are attached to each side of the headstall strap near the top. A throat latch is made of three pieces: a left throat latch strap 242, a right throat latch strap 244, and a throat latch buckle 246. The left throat latch strap 242 is attached to the left cheek ring and is provided with a number of adjustment holes 248. The buckle 246 is fitted to one end of the right throat latch strap the end of the right throat latch strap 244. The right throat latch strap end opposite buckle 246 is secured to the right cheek ring. In use the throat latch buckle 246 engages a hole 248 on the left throat latch strap 242 as selected the user.

The four piece nose band 260 includes a front nose band 262, a rear nose band 264, and two halter squares 266, namely one halter square on each side of the halter. The second halter square is not visible in this Figure. Loops 268 are formed on each side of the rear nose band 264 and are sized to slide on the headstall strap 220. The nose band position is regulated by hanger straps 250 located one on each side of the halter.

In this figure, hanger strap 250 on the left side of the halter is visible and the right hanger strap is not visible. Each hanger strap 250 is comprised of three parts: an upper hanger strap 252, a lower hanger strap 254, and a hanger strap buckle 256. One end of the lower hanger strap 254 is fitted into the top position of the halter square 266, however, as an alternative it could be sewed directly to the nose band if it was desirable to eliminate the halter square. Hanger strap buckle 256 is fitted to the end of the lower hanger strap 254 opposite the halter square and is preferably secured by stitching as is common in the art.

One upper hanger strap 252 is secured to each cheek ring 226 by stitching or other suitable connecting method. The upper hanger strap is fitted with a series of holes 258. Hanger strap buckles 256 on each side of the halter engage holes 258 to support the nose band 260 at the desired position. It is understood that hanger strap 250 and its parts (the upper hanger strap 252, lower hanger strap 254, hanger strap buckle 256, and the hanger strap adjustment holes 258) are mirrored on the right side of the halter. The halter of FIG. 5 is preferably manufactured from nylon webbing and metal rings however it may be manufactured without the rings, so that buckles are the only metal parts. Leather straps or any other materials that will not chafe the horse and that provide adequate strength may be substituted for nylon webbing. The great benefit of this halter is the strength of the headstall strap as it is formed into a continuous permanent loop without detachable connecting means such as buckles. As a result of this permanently formed continuous loop the headstall strap has adequate strength that a horse cannot pull back and break the halter, thereby solving a common problem with halters available in the market today.

Figure 6:
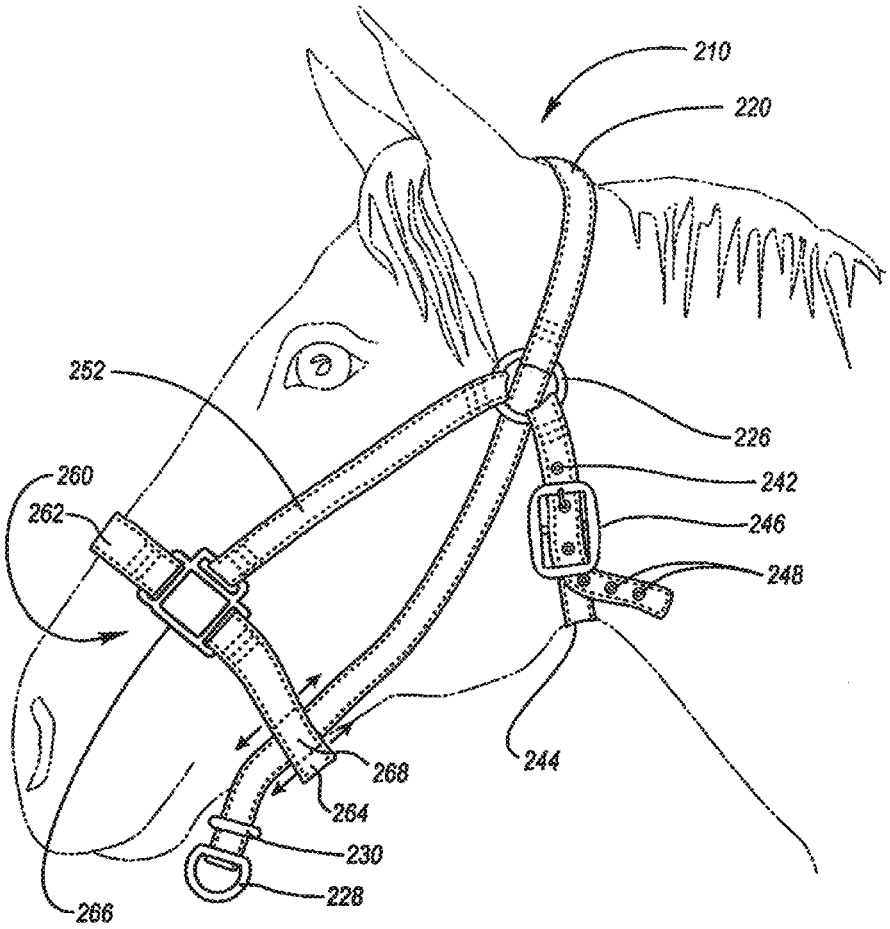
FIG. 6 shows a fourth embodiment of the horse halter fitted on a horse.

FIG. 6 shows another embodiment of the halter 210 fitted on a horse. The halter of FIG. 6 differs from the halter of FIG. 5 having a fixed length hanger straps 250. Only the left side of the halter is visible in FIG. 6 and the fixed length right hanger strap is not visible. The position of nose band 260 is not adjustable. The non-adjustable halter shown in FIG. 6 does not include a brow band.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

Examples of various embodiments within the spirit and scope of the invention include the option of making the halter with or without a brow band. Another example of an optional feature is the use of adjustable hanger straps or fixed hangers straps.

What is claimed is:

1. A halter for an animal having a head and a nose, said halter comprising:

a headstall strap permanently formed into a continuous loop, said headstall strap configured to fit over said animal's head, said headstall strap comprising a right side, a left side, a top, a bottom, a front and a rear, said headstall strap passing through a lead attachment ring;

a throat latch attached to said headstall strap for securing said halter to said animal's head, said throat latch comprising a right throat latch strap, a left throat latch strap, a throat latch buckle and a plurality of holes, said right throat latch strap comprising a first end and a second end, said left throat latch strap comprising a first end and a second end, said holes located near said second end of said left throat latch strap, said first end of said left throat latch strap is fixedly attached to said left side of said headstall strap, said throat latch buckle is attached to said second end of said right throat latch strap, said first end of said right throat latch strap is fixedly attached to said right side of said headstall strap, said holes in said left throat latch strap are configured for adjustable engagement with said throat latch buckle;

a nose band configured to fit around said animal's nose, said nose band comprising a front nose band, and a rear nose band, said rear nose band comprising a right side and a left side, said right side comprising a right side loop, said left side comprising a left side loop, said right side loop configured for slideable engagement with said right side of said headstall strap, said left side loop configured for slideable engagement with said left side of said headstall strap; and two hanger straps comprising a right side hanger strap and a left side hanger strap, each of said right side and left side hanger straps comprising an upper hanger strap, a lower hanger strap, a hanger strap buckle and a plurality of holes, each upper hanger strap comprising a first end and a second end, each lower hanger strap comprising a first end and a second end, each upper hanger strap fitted with said plurality of holes therethrough located near said second end of said upper hanger strap, said first end of each upper hanger strap is fixedly attached to said headstall strap, said second end of each lower hanger strap is fixedly attached to said nose band, said first end of each lower hanger strap is attached to one of said hanger strap buckles, each hanger strap buckle configured for adjustable engagement with said holes in said upper hanger strap, wherein one of said hanger straps is located on said right side of said halter, and one of said hanger straps is located on said left side of said halter.

2. The halter of claim 1, wherein said throat latch and said left side hanger strap are fixedly attached to said headstall strap using a first ring, and wherein said throat latch and said right side hanger strap are fixedly attached to said headstall strap using a second ring.

3. The halter of claim 2, wherein said left side and right side hanger straps are fixedly attached to said nose band using left and right halter squares, wherein said left halter square is attached to said left side of said nose band, and wherein said right halter square is attached to said right side of said nose band.

4. The halter of claim 3, wherein said halter further comprises a guide ring, said guide ring sized to slideably fit over said headstall straps, said guide ring sized so said lead ring will not pass through said guide ring, said guide ring is positioned above said lead ring and below said nose band, said guide ring encloses said left side and said right side of said headstall, and said guide ring holds said headstall strap sides together.

5. The halter of claim 1, wherein said left side and right side hanger straps are fixedly attached to said nose band using left and right halter squares, wherein said left halter square is attached to said left side of said nose band, and wherein said right halter square is attached to said right side of said nose band.

6. The halter of claim 1, wherein said halter further comprises a guide ring, said guide ring sized to slideably fit over said headstall strap, said guide ring sized so said lead ring will not pass through said guide ring, said guide ring is positioned above said lead ring and below said nose band, said guide ring encloses said left side and said right side of said headstall strap, and said guide ring holds said headstall strap sides together.

7. The halter of claim 1, wherein: said throat latch and said left side hanger strap are fixedly attached to said headstall strap using a first ring; said throat latch and said right side hanger strap are fixedly attached to said headstall strap using a second ring; said left side and right side hanger straps are fixedly attached to said nose band using left and right halter squares; said left halter square is attached to said left side of said nose band; and said right halter square is attached to said right side of said nose band.

8. The halter of claim 1, wherein: said throat latch and said left side hanger strap are fixedly attached to said headstall strap using a first ring; said throat latch and said right side hanger strap are fixedly attached to said headstall strap using a second ring; said left side and right side hanger straps are fixedly attached to said nose band using left and right halter squares; said left halter square is attached to said left side of said nose band; said right halter square is attached to said right side of said nose band; and said halter further comprises a guide ring, said guide ring sized to slideably fit over said headstall strap, said guide ring sized so said lead ring will not pass through said guide ring, said guide ring is positioned above said lead ring and below said nose band, said guide ring encloses said left side and said right side of said headstall strap, and said guide ring holds said headstall strap sides together.

9. A halter for an animal having a head, throat and a nose, said halter comprising:

a headstall strap permanently formed into a continuous loop, said headstall strap configured to fit over said animal's head, said headstall strap comprising a right side, a left side, a top, a bottom, a front and a rear, said headstall strap passing through a lead attachment ring;

a brow band, said brow band comprising a right end and a left end, a front and a rear, each end of said brow band comprising front loop and a rear loop, the front loop on each end of said brow band is a headstall loop, the rear loop on each end of said brow band is a throat latch loop, said headstall loops slideably engage said headstall;

a throat latch comprising a first end, a second end, a right side, a left side, a top and a bottom, said throat latch comprising a throat latch strap, a throat latch buckle and a plurality of holes in said throat latch strap, said holes located near said second end of said throat latch strap, said throat latch buckle attached to said throat latch strap first end, said throat latch buckle configured for adjustable engagement with said throat latch holes, said throat latch configured to slideably engage said throat latch loops on said brow band, said throat latch configured for adjustable attachment around said neck of said animal for securing said halter on said animal;

a nose band configured to fit around said animal's nose, said nose band comprising a front nose band, and a rear nose band, said rear nose band comprising a right side and a left side, said right side comprising a right side loop, said left side comprising a left side loop, said right side loop configured for slideable engagement with said right side of said headstall strap, said left side loop configured for slideable engagement with said left side of said headstall strap; and two hanger straps comprising a right side hanger strap and a left side hanger strap, each of said right side and left side hanger straps comprising an upper hanger strap, a lower hanger strap, a hanger strap buckle and a plurality of holes, each upper hanger strap comprising a first end and a second end, each lower hanger strap comprising a first end and a second end, each upper hanger strap fitted with said plurality of holes therethrough located near said second end of said upper hanger strap, said first end of each upper hanger strap is fixedly attached to said headstall strap, said second end of said left lower hanger strap is fixedly attached to said rear nose band left side said second end of said right lower hanger strap is fixedly attached to said rear nose band right side, said first end of each lower hanger strap is attached to one said hanger strap buckles, and each hanger strap buckle is configured for adjustable engagement with said plurality of holes in said upper hanger strap wherein one of said hanger straps is located on said right side of said halter, and one of said hanger straps is located on said left side of said halter.

10. The halter of claim 9, wherein said left side hanger strap is fixedly attached to said headstall strap left side using a first ring, and wherein said right side hanger strap is fixedly attached to said headstall strap right side using a second ring.

11. The halter of claim 8, wherein said left side and right side hanger straps are fixedly attached to said nose band using left and right halter squares, wherein said left halter square is attached to said left side of said nose band, and wherein said right halter square is attached to said right side of said nose band.

12. The halter of claim 9, wherein said left side and right side hanger straps are fixedly attached to said nose band using left and right halter squares, wherein said left halter square is attached to said left side of said nose band, and wherein said right halter square is attached to said right side of said nose band.

13. The halter of claim 7, wherein said halter further comprises a guide ring, said guide ring sized to slideably fit over said headstall strap, said guide ring sized so said lead ring will not pass through said guide ring, said guide ring is positioned above said lead ring and below said nose band, said guide ring encloses said left side and said right side of said headstall, and said guide ring holds said headstall sides together.

* * * * *